US012329302B2

(12) United States Patent
Seiser

(10) Patent No.: US 12,329,302 B2
(45) Date of Patent: Jun. 17, 2025

(54) CLOTHES HANGER

(71) Applicant: Markus Seiser, Münchenstein (CH)

(72) Inventor: Markus Seiser, Münchenstein (CH)

( * ) Notice: Subject to any disclaimer, the term of this patent is extended or adjusted under 35 U.S.C. 154(b) by 0 days.

(21) Appl. No.: 18/282,326

(22) PCT Filed: Mar. 16, 2022

(86) PCT No.: PCT/EP2022/056829
§ 371 (c)(1),
(2) Date: Nov. 20, 2023

(87) PCT Pub. No.: WO2022/194934
PCT Pub. Date: Sep. 22, 2022

(65) Prior Publication Data

US 2024/0156291 A1 May 16, 2024

(30) Foreign Application Priority Data

Mar. 18, 2021 (DE) ..... 10 2021 106 630.1

(51) Int. Cl.
*A47G 25/40* (2006.01)

(52) U.S. Cl.
CPC ..... *A47G 25/4023* (2013.01)

(58) Field of Classification Search
CPC ..... A47G 25/4023
See application file for complete search history.

(56) References Cited

U.S. PATENT DOCUMENTS 1,101,088 A * 6/1914 Olson ..... A47G 25/4023 223/89
1,278,054 A * 9/1918 Strand ..... A47G 25/4023 223/89
2,872,090 A 2/1959 Goodman
3,802,610 A 4/1974 Love et al.
(Continued)

FOREIGN PATENT DOCUMENTS

CH 621694 A5 2/1981
CN 208658617 U 3/2019
(Continued)

OTHER PUBLICATIONS

Examination Report created Oct. 27, 2021 in related/corresponding DE Application No. 10 2021 106 630.1.
(Continued)

*Primary Examiner* — Shaun R Hurley
(74) *Attorney, Agent, or Firm* — PATENT PORTFOLIO BUILDERS PLLC

(57) ABSTRACT

A clothes hanger has two limbs, each of which has a limb arm. The limb arms are elastically connected together via a housing cassette. The housing cassette forms the apex of an angle, and the limb arms form the two legs of the angle. The size of the angle can be reduced by pivoting the limbs about a pivot axis, thereby building up a restoring force by means of the elastic connection. The limbs are secured against an accidental pivoting of the limb arms via at least one locking mechanism, and corresponding blocking elements of the locking mechanism or the locking mechanisms move away from each other or towards each other in the event of a pivoting movement of the limbs.

17 Claims, 6 Drawing Sheets

(56) References Cited

U.S. PATENT DOCUMENTS

Figure 1:
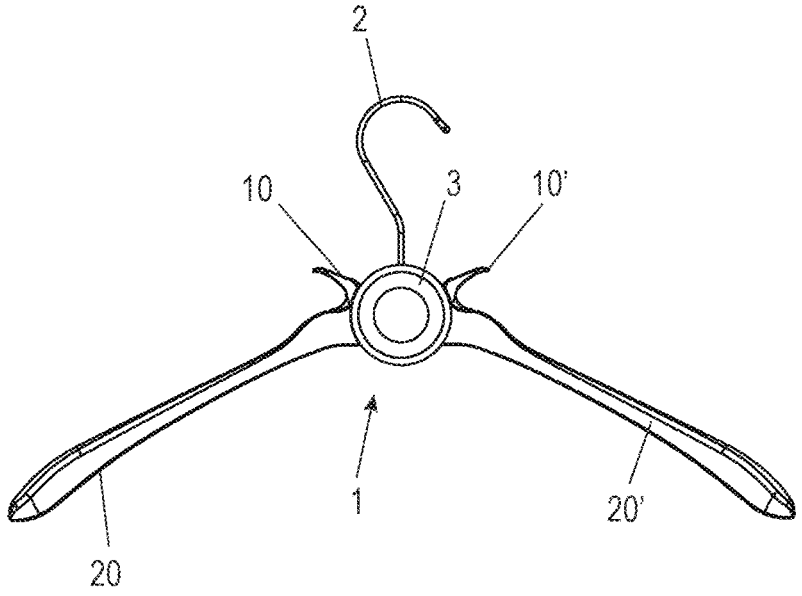

| | | | | | |
|---|---|---|---|---|---|
| 4,117,960 | A * | 10/1978 | Bengsch | A47G 25/4023 223/94 |
| 5,397,037 | A * | 3/1995 | Ozawa | A47G 25/4023 223/89 |
| 5,480,076 | A * | 1/1996 | Siegel | A47G 25/4038 403/111 |
| 5,590,823 | A | 1/1997 | Lunde | |
| 7,237,702 | B2 * | 7/2007 | Landis | A47G 25/4023 223/89 |
| 7,828,179 | B2 * | 11/2010 | Sprovieri | A47G 25/4023 223/94 |
| 2004/0211797 | A1 | 10/2004 | Landis et al. | |
| 2005/0242135 | A1 | 11/2005 | Lam | |

FOREIGN PATENT DOCUMENTS

| | | | | | |
|---|---|---|---|---|---|
| CN | 110575037 | A | * 12/2019 | | A47G 25/4023 |
| CN | 210540621 | U | * 5/2020 | | A47G 25/4023 |
| CN | 111345659 | A | * 6/2020 | | A47G 25/183 |
| CN | 111588255 | A | * 8/2020 | | A47G 25/4046 |
| DE | 2629964 | A1 | 1/1977 | | |
| DE | 2616143 | A1 | 10/1977 | | |
| DE | 2832768 | A1 | * 2/1979 | | A47G 25/4023 |
| DE | 2050732 | C3 | 4/1981 | | |
| DE | 2629964 | C3 | 1/1982 | | |
| DE | 9102734 | U1 | 5/1991 | | |
| DE | 19708943 | A1 | 9/1998 | | |
| DE | 19818567 | A1 | * 10/1999 | | A47G 25/4023 |
| DE | 19856899 | A1 | 3/2000 | | |
| DE | 202004009288 | U1 | * 11/2004 | | A47G 25/4023 |
| DE | 202009002037 | U1 | 6/2009 | | |
| ES | 2755850 | A1 | * 4/2020 | | |
| KR | 20020034719 | A | 5/2002 | | |
| KR | 20060115305 | A | * 11/2006 | | |
| KR | 20130124658 | A | * 11/2013 | | |
| KR | 20180093426 | A | * 8/2018 | | |
| WO | WO-03013322 | A1 | * 2/2003 | | A47G 25/4023 |
| WO | WO-2020069315 | A1 | * 4/2020 | | A47G 25/40 |

OTHER PUBLICATIONS

International Search Report and Written Opinion mailed Jul. 14, 2022 in related/corresponding International Application No. PCT/EP2022/056829.

* cited by examiner

CLOTHES HANGER

BACKGROUND AND SUMMARY OF THE INVENTION

Exemplary embodiments of the present invention relate to a garment hanger.

There is a separate IPC class A47G25/40 for foldable hangers, but despite extensive variations in the patent literature, foldable hangers have not yet gained industrial acceptance.

One reason for this could be the low manufacturing costs of a conventional clothes hanger, which outweigh the advantages of foldability. Only by way of example, some variants of foldable coat hangers known from patent specifications are explained in more detail below.

According to the generic concept of the present invention, the legs of the clothes hanger according to the invention should be arranged so as to be pivotable relative to each other. This is necessary so that the hanger can be inserted through the collar of a shirt, through a T-shirt or sweater neckline.

DE 20 2004 009 288 U1 discloses a clothes hanger with two legs coupled via a toothing. These legs can be pivoted against each other by a pivoting angle while changing the angular width between the legs. Furthermore, the legs have a cross-connecting bar which allows the holding of a pair of trousers in addition to an outer garment. The crossbar blocks a pivoting movement of the legs.

CH 621 694 A also discloses a coat hanger with legs which can be coupled together by means of a toothing and are locked by a latch mechanism on the underside of the coat hanger to prevent unintentional pressing down. However, this mechanism is small in size and therefore expensive. At the same time, the legs must first be straightened after insertion, and the latch must be set on the underside—i.e., in the area inside the shirt.

DE 2 629 964 C3 discloses a clamping mechanism, by actuation of an element in shirt interior.

DE 2 050 732 C3 proposes a locking mechanism as a bayonet catch.

DE 2 616 143 discloses a clothes hanger with two swivel axes running parallel to each other. A latch mechanism is used for fixing. The additional bearing and the constructive design complicate the construction of the clothes hanger and make it too expensive for practical implementation. A similar principle is pursued with DE 20 2009 002 037 U1, U.S. Pat. No. 2,004,211 797 AA.

Then there are hangers having a simple structure, but which can unintentionally swivel when subjected to high loads, e.g., when hanging a heavy coat. If the hanger should nevertheless hold this load, the spring force is so great that the practical handling of the spring-loaded swiveling is endangered and can only be carried out with considerable effort. This is also not acceptable.

Typical examples can be found in DE 197 08 943 A1, DE 91 02 734 U1, U.S. Pat. Nos. 5,590,823 A, 3,802,610 or even U.S. Pat. No. 2,872,090 A.

Based on the aforementioned problem, exemplary embodiments of the present invention provide a clothes hanger that satisfactorily solves the aforementioned problems and has a structure with few components made of plastic or other possible alternative materials suitable for mass production, so that manufacturing costs can be reduced.

A clothes hanger according to the invention has two legs. Each of the legs has a leg arm. The leg arms are resiliently connected to one another via a housing cassette, so there is a resilient connection between the leg arms. The legs can partially form the housing cassette or individual segments, in particular a housing cover segment of a respective leg, can be part of the housing cassette.

The housing cassette forms an angular vertex of an angle and the leg arms form the two angular legs of this angle.

The angular width of the angle can be reduced by a pivoting movement about a pivot axis of the legs. This is done by building up a restoring force through the resilient connection, which counteracts the pivoting movement of the leg arms towards each other.

The legs are secured against unintentional pivoting of the leg arms by at least one latching mechanism, preferably two latching mechanisms.

The latching mechanisms are preferably accessible from the outside when the hanger is hung and can therefore be released from the outside.

In the case of a sweater, for example, this means that you do not have to reach into the collar or under the garment to release the latching mechanism.

The latching mechanism, in particular each latching mechanism, can have two corresponding latching elements, in particular a latching lug and a corresponding latching groove, the latching elements being connected to the legs and/or the housing cassette or being integrally formed on these legs and/or the housing cassette. This further reduces the number of parts.

The housing cassette can be partially formed by the legs, in particular by housing cover segments formed on the leg arms. This also reduces the amount of work involved in manufacture.

The legs can have at least two latching mechanisms of identical shape, preferably with two corresponding latching elements, so that the garment hanger is secured against unintentional pivoting of the leg arms. The identical shape latching mechanisms can be implemented in a single tool, for example, for plastic processing. The similarity in shape increases ease of operation and enables better force distribution.

Each leg can have at least one leg arm and a housing cover segment, with one of the corresponding latching elements, preferably a latching lug, being formed on the housing cover segment. This also further reduces the number of parts.

The latching mechanisms can be arranged on opposite sides of the housing cassette for better force absorption and distribution and for better operability, with one of the latching means of each latching mechanism being arranged on the housing cassette, in particular on its outer circumference.

The latching elements are accessible from the outside, particularly when the hanger is covered with outer clothing, so that operation is facilitated and possible damage to the latching mechanism can be quickly identified.

The housing cassette can have a cavity in which a spring, preferably a metal spring, is arranged, which is fixed to the two legs forming the resilient connection.

The legs can have a radial stop inside the housing cassette for the limitation of the swivel movement. The housing chain protects the mechanics on the one hand and allows a compact design on the other.

The clothes hanger can have an operating element connected to the leg in a material-locking manner or is connected to the leg, in particular the housing cover segment of the leg, in a form-fitting manner, e.g., by latching, preferably tiltably about a tilting axis.

The operating element preferably has a detent element of the detent mechanism, in particular a detent groove.

The hanger can be made inexpensively and suitable for mass production, apart from the spring for resilient connection of the legs and a suspension for fixing the hanger, from plastic or other alternative materials, for example liquid wood.

It is advantageous if the corresponding latching elements of the latching mechanism or mechanisms move away from or towards each other during the pivoting movement of the legs, so that automatic latching results when the legs are moved into the clamping position, without the need for additional hand grips.

The corresponding latching elements of the latching mechanism or mechanisms may be arranged on the operating element and on the housing cassette relative to one another in such a way that the latching mechanism or mechanisms can be released by tilting the operating element relative to the housing cassette.

The spring can preferably be designed as a torsion spring and/or torsion spring, in particular made of spring steel.

Since similar or analogous tools, e.g., injection molds, can be used, it is advantageous if the hanger, apart from the suspension, is of mirror-symmetrical design, with the legs, preferably point-symmetrical to each other.

The garment hanger may comprise two legs with housing cover segments formed thereon, a center ring between the housing cover segments, a hanger secured to the center ring, a spring disposed in the housing cassette, and the two controls.

The latching mechanism(s) is/are located above the legs towards the suspension and thus not covered by a shirt when actuated for latching and unlatching.

BRIEF DESCRIPTION OF THE DRAWING FIGURES

Figure 2:
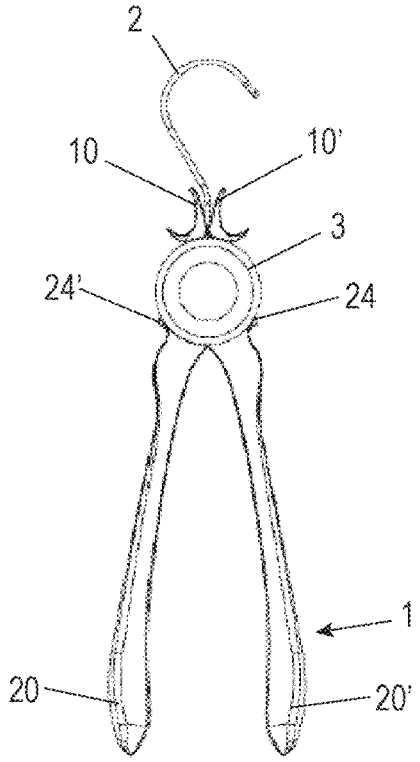
Figure 3:
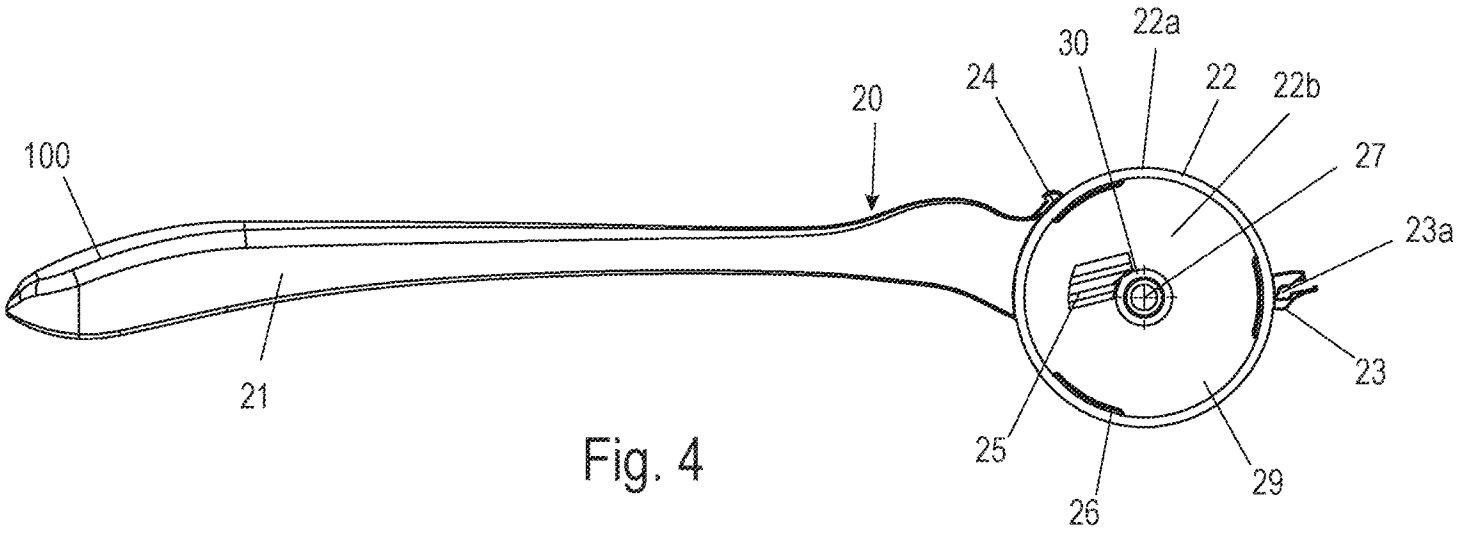
Figure 4:
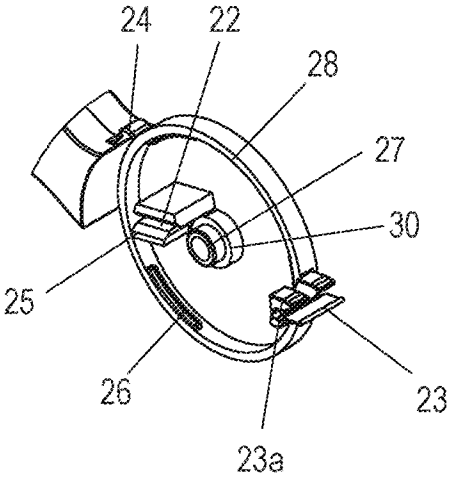
Figure 5:
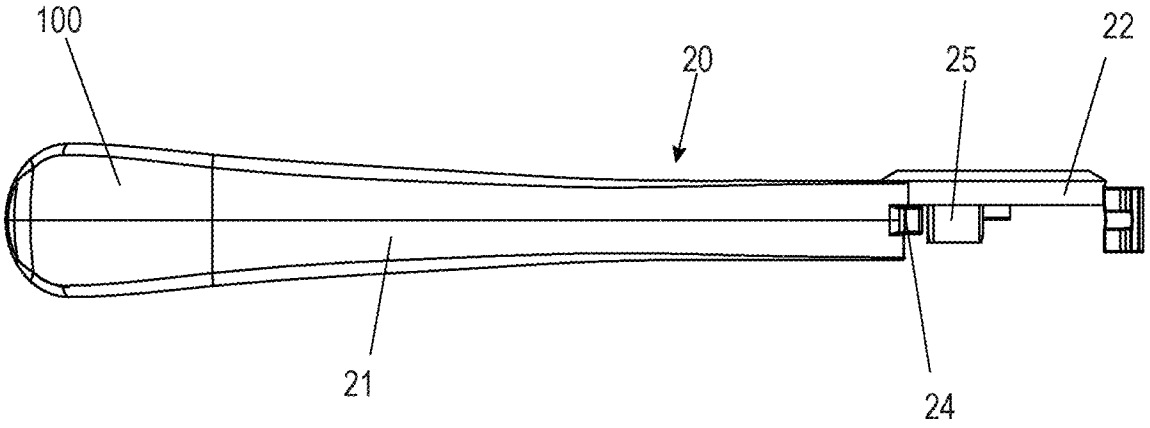

Further advantages, features and details of the invention will be apparent from the following description, in which an embodiment of the invention is explained in more detail with reference to the accompanying drawings. The skilled person will expediently also consider the features disclosed in combination in the drawing, the description and the claims individually and combine them to form useful further combinations. In particular, there are a multitude of possibilities for modifying and further forming the clothes hanger according to the invention within the scope of the present invention. Showing:

FIG. 1 Front view of a clothes hanger according to the invention in the stretched state;

FIG. 2 Front view of a garment hanger according to the invention in the bent state for insertion into a garment;

FIG. 3 Front view of a clothes hanger leg;

FIG. 4 partial perspective view of a housing cassette section of the hanger leg of FIG. 3;

FIG. 5 Top view of the hanger leg of FIG. 3-4

Figure 6:
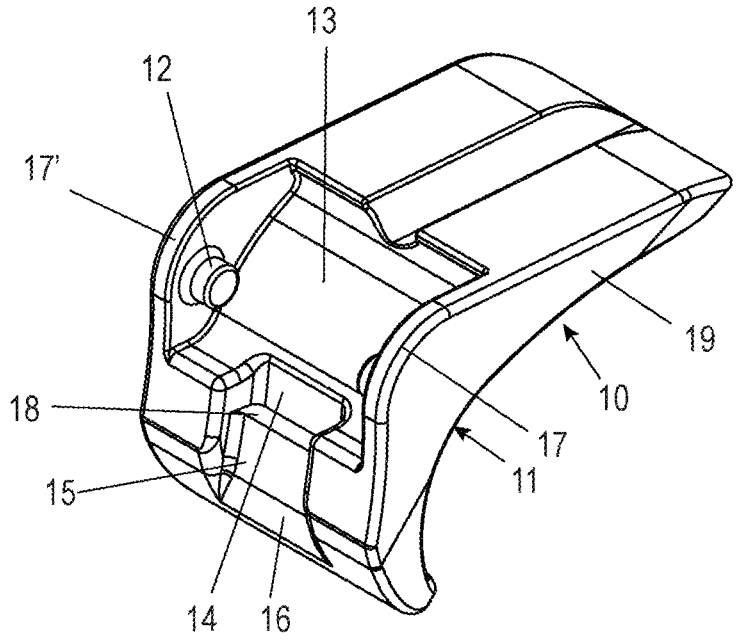

FIG. 6 Perspective view of a garment hanger clip for connection to the garment hanger of FIGS. 3-5

Figure 7:
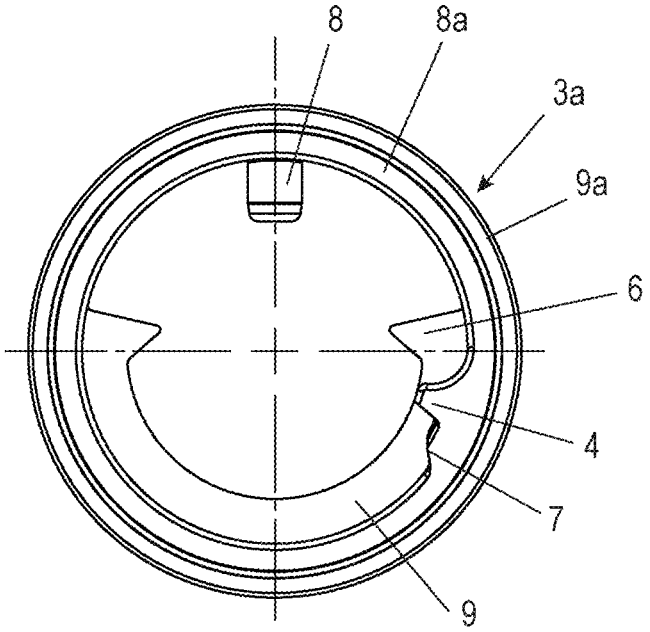
Figure 8:
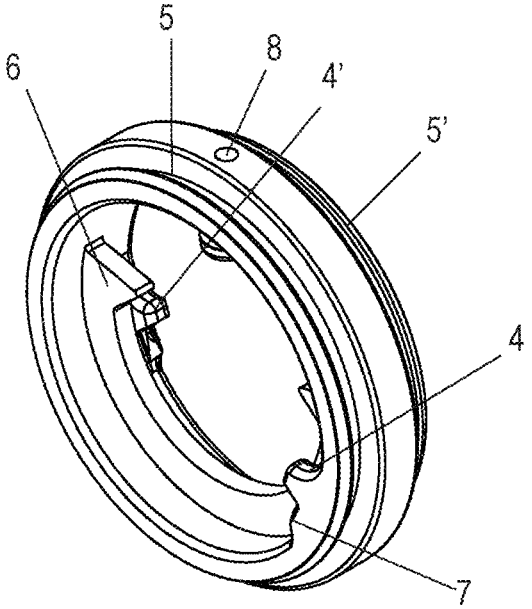
Figure 9:
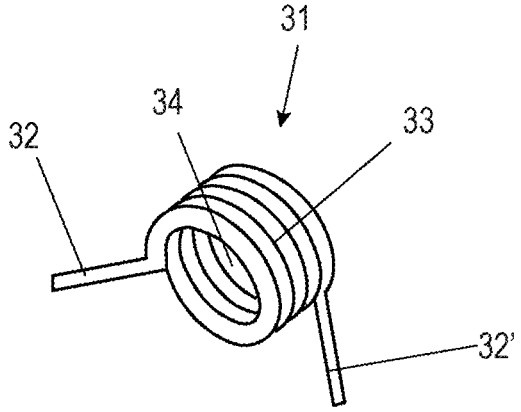
Figure 10:
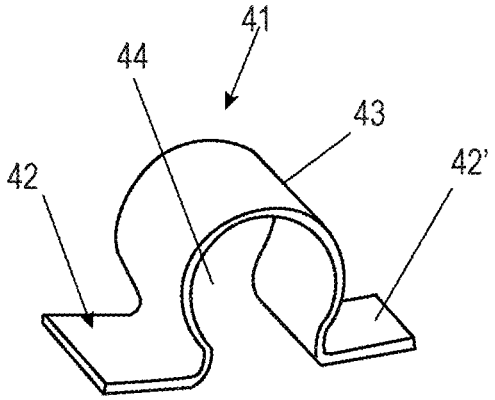

FIG. 7 Top view of an annular center component of a housing cassette of the garment hanger;

FIG. 8 Perspective view of the ring-shaped center component of FIG. 7;

FIG. 9 Perspective view of a first variant of a spring for use in the hanger of FIG. 1; and FIG. 10 Perspective view of a second variant of a spring for use in the hanger of FIG. 1.

DETAILED DESCRIPTION

FIGS. 1-10 disclose several components of an embodiment of a clothes hanger 1 according to the invention. Identical segment, components or segments are described with the same reference signs.

FIG. 1 shows the clothes hanger 1 in front view. The hanger is in the stretched state and in this state enables garments to be held, in particular—but not exclusively—outerwear garments such as shirts, sweaters, T-shirts, jackets, coats and the like.

For this purpose, the hanger 1 has two legs 20, 20' that are angled towards each other at an angle of preferably between 90-180°. The hanger 1 shown in FIG. 1 has a mirror-symmetrical design.

The legs 20, 20' are resiliently connected to each other via a housing cassette 3 in such a way that the angular width between the legs can be reduced while building up a restoring force.

In this respect, a pivot axis is formed between the legs 20, 20'. The restoring force is built up by a spring, in particular a metal spring, which is shown in two preferred embodiments in FIGS. 9 and 10.

In order to prevent unintentional deflection of the legs 20, 20' under higher load, the hanger 1 has a latching mechanism which can be activated or released in an uncomplicated manner.

The uncomplicated operation of the latching mechanism significantly reduces the number of hand grips required to operate the garment hanger 1 and significantly increases the acceptance of the garment hanger 1 among users.

For activating and releasing the latching mechanism, each leg can have an operating element 10, 10', which has a latching means 24. This may preferably be a detent lug or a detent groove corresponding to the detent lug. Latching, unlike, for example, clamping, is a form-fit and force-fit between two components. A special feature of the clothes hanger according to the invention is that the corresponding latching elements are each formed on the legs 20, 20' or are fixed to the legs 20, 20' via the operating elements 10, 10'. Thus, the latching elements can be moved towards each other or brought into positive engagement with each other by the pivoting movement of the legs 20, 20' and/or can be spaced apart from each other after the latching mechanism of the legs 20, 20' has been released as part of the pivoting movement.

In a non-shown embodiment, the respective operating element 10, 10' can be integrally connected to the leg 20, 20'. In a further embodiment, which can be seen in FIG. 6, among others, the operating element 10, 10' can be rigidly or tiltably connected to the leg 20, 20' about a tilt axis.

The housing cassette 3 has a cassette cavity in which the respective spring, e.g. the spring 31 or 41 of FIG. 9 or 10, is arranged.

FIG. 2 shows a representation of the clothes hanger according to the invention in the bent state. In this case, the angle between the legs 20, 20' has been reduced to a dimension of less than 90° by a pivoting movement of the legs 20, 20' towards each other and about the pivot axis.

The respective latching element 24 of the leg 20 or 20', which is arranged in the area of the housing cassette 3, is disengaged from the corresponding latching element 14 of the operating element 10, 10', which is arranged on the respective other leg 20' or 20.

Thus, in the stretched state of FIG. 1, the hanger 1 is at the same time in a latched state, while in the bent state of FIG. 2, it is in the unlatched or released state.

Specifically, the detent means 14 of the respective operating element 10, 10' is a detent groove and the corresponding detent means 24 of the leg 20, 20' on the outer circumference of the housing cassette 3 is a detent lug.

The legs 20, 20', the operating elements 10, 10', and the center component 3 are preferably made of plastic. The legs 20, 20' are components of identical shape but of mirror-inverted construction. The operating elements 10, 10' are also of the same shape and, as mentioned above, can also be integrally formed on the legs.

The spring 31, 41 can preferably be made of a metal, preferably a spring steel. The suspension 2 fixed to the center component 3 can be made of metal for reasons of optimum load absorption.

The structure of a leg 20 or 20' is explained in detail below, in particular with reference to FIGS. 3-5.

The leg 20 has a leg arm 21 for taking up the load of a garment. The leg arm 21 has a support surface 100, which widens at the end in order to provide a better, in particular more form-fitting, support for articles of clothing. There are also variants within the scope of the invention whose leg arms remain narrowly shaped at the end. Furthermore, the leg arm 21 has a u-shaped profile in a cross-section perpendicular to their main direction of extension. The u-shaped profile can be additionally stabilized against deformations by means of non-displayed underside-arranged transverse struts.

The housing cassette 3 is formed by two pot-shaped housing cover segments 22 and the annular center component 3*a*, which is arranged between the housing cover segments 22.

The pot-shaped housing cover segment 22 described above has a cylindrical wall 22*a* and a flat cover base 22*b* and is thereby part of the leg 20 and terminally adjoins the leg arm 21. Along the outer circumference of the housing cover segment 22, in particular the wall 22*a*, is arranged the latching element 24 designed as a latching lug, which in the case of FIGS. 3-5 is preferably arranged above the leg arm 21.

The position "above" is defined in the hanger according to the invention on the basis of the suspension 2 in the intended use of the hanger 1. This suspension 2 is also arranged above the leg arms 21 of the legs 20 and 20'.

Also arranged on the outer circumference of the housing cover segment 22 and on the opposite side of the leg arm 21 is a coupling segment 23 for connection to the operating element 10. The coupling segment 23 has a groove 23*a* in which an axle bolt segment 12 of the operating element 10 can be arranged. The groove 23*a* is thereby formed with a groove constriction arranged in the central region of the groove 23*a*, that the groove constriction can be widened by mechanical pressure, so that an axle bolt 12 is pressed into the groove 23*a* and is rotatably held in its position in the groove 23*a* by the groove constriction.

The housing cover segment 22 also has a receiving pin 27, preferably a receiving pin 27 with a stepped contour in axial extension. The receiving pin 27 is designed for fitting a spring 31, 41 of circular or arcuate design. The spring 31, 41 thereby has a circular or arcuate spring body 33, 43, which can be arranged around the receiving pin 27, so that the spring 31, 41 is held in the housing cassette 3 by the receiving pin 27. The receiving pin 27 thereby protrudes from the inner side of the lid base 22*b* into the cavity 29 of the housing cassette 3.

Furthermore, the housing cover segment 22 has one or more arcuate radial guide webs 26 along the inner circumference and preferably extending parallel to the wall 22*a*. The radial guide webs 26 may, for example, be circumferentially distributed along the inner circumference or may be a single circumferential web. The central component 3*a*, has a groove 5 or 5' corresponding to the radial guide webs 26, preferably circumferential, in which the radial guide webs 26 can engage, in particular with a form fit. The radial guide webs 26 facilitate guidance during the pivoting movement and at the same time enable retention between the legs 20, 20' and the central component 3*a* of the garment hanger 1 with formation of the housing cassette 3.

Furthermore, the housing cover segment 22 has a radial stop 25 which protrudes from the cover base 22*b*, preferably parallel to the receiving pin 27. The radial stop 25 limits the pivoting movement of the legs 20, 20' relative to each other so that the angle between the legs 20, 20' is maximum in the stretched state of FIG. 1.

The counter stop 4 to the radial stop 25 is part of the center component 3*a*. The radial stop 25 and the counter stop 4 limit the pivotability of a leg 20 or 20' in one direction. In the other pivoting direction towards the other leg in each case, there is no limitation in the embodiment example shown in FIGS. 1-10; however, a center stop can optionally be provided centrally between the counter stops 4 and 4' arranged on both sides.

The radial stop 25 has a recess, in particular a groove 28, in which a spring leg 32, 42 of the spring 31, 41, arranged in the housing cassette, can be anchored.

In its axial extension, the receiving pin 27 has a section with a smaller radius and a section 30 with a larger radius, which opens into the lid base 22*b*. This section serves as a spacer for the spring 31 or 41 with respect to the lid base 22*b* in order to avoid mechanical stress, e.g., abrasion of the material of the lid base 22*b* by the spring movement.

FIG. 6 shows a control element 10. The control element 10 has a connection area 13 in the form of a recess, in which an axle pin 12 is arranged in each of two opposite edge areas 17, 17', each of which is designed as a pin stub. However, it is also possible to provide a continuous axle pin which extends from one edge region 17 to the other edge region 17'.

The axle pins 12 are arranged in the groove 23*a* of the coupling segment 23 when the operating element 10 is assembled, so that a connection between the operating element 10 and the leg 20 is achieved.

In addition, the operating element 10 has a latching element 14 formed as a latching groove. This latching element 14 corresponds to the latching element of the latching element of the second leg 20' arranged on the housing cover segment in each case, so that the pivoting movement of the leg 20 relative to the leg 20' and vice versa can be blocked by the latching.

As can be seen from FIG. 2 and the further figures, a total of two latching mechanisms, each with two corresponding latching elements, are arranged, with one of the latching elements 24 of the first latching mechanism being arranged on the outer circumference of the housing cassette 3 in each case and facing the latching element 24' of the second latching mechanism. Due to the double latching, an ideal locking of the pivotability is achieved, so that the clothes hanger 1 does not bend under too high a load.

The latching element 14 of the operating element 10 has a step 18 which extends at an angle of preferably between 75-105°, in particular by 90°+/−5°, relative to the adjacent surfaces. This step 18 is engaged behind by the corresponding latching element 24.

The step 18 is preceded by a support surface 15 for supporting the corresponding latching element 24' in certain areas, and in front of this support surface 15 there is an inlet slope 16 to facilitate merging with the corresponding latching element 24' of the leg 20'.

The control element 10 also has a finger rest 11. This can be ribbed or otherwise have a roughened surface for better operation. The specific shape of the operating element 10 can vary. In the present case, the operating element 10 has a wing segment 19 protruding from the housing cassette 3 and, in the stretched state of the clothes hanger 1, above the leg 20' with the corresponding latching element 24'.

In this embodiment, the control element 10 is tiltably connected to the leg 20 via a hinge joint, as explained previously.

However, it is also possible to provide a material-locking rigid connection in which the latching of the latching elements can take place via elastic material deformation, in particular of the material of the operating element 10.

FIGS. 7 and 8 show the annular central part 3*a*, which is part of the housing cassette 3. The central part 3*a* has a longitudinal axis running perpendicular to an annular plane through the annular means of the central part.

The central part 3*a* has two counterstops 4 and 4', which are arranged on ring planes parallel offset along the longitudinal axis.

Further, the center part 3*a* has a receptacle 8 for connecting the suspension. The suspension can be, for example, a hook or a rod and ball combination.

The receptacle defines a transverse axis through the center part 3*a*, which extends perpendicular to the longitudinal axis. The counter stops 4, 4' are arranged at the same angle to the transverse axis on the inner circumference of the center part 3*a*. In front of the counter stops 4, 4' are inlet slopes 7, which already slow down the swiveling movement in front of the counter stops 4, 4' and, in addition to the provided detent mechanisms, allow the legs 20, 20' to be clamped to the center part 3*a*.

In addition, the center part 3*a* has a U-shaped radial guide web 9 with end stops 6 on a ring plane between the counter stops 4 and 4'. The radial guide web 9 allows the center part 3*a* to be guided in a partial rotation relative to the legs 20, 20'. This partial rotation is limited by the end stops 6.

FIGS. 9 and 10 show two spring variants 31, 41 for use in the hanger 1.

FIG. 9 shows a torsion spring. This has the spring legs 32, 32' for engagement in the groove 28 of the radial stop 25 of the leg 20 and a corresponding groove of a radial stop of the leg 20'. Between the spring legs 32, 32', a multi-coiled spring body 33 is arranged, which has a free space 34 in the center, into which the receiving pin 27 can be inserted at least in certain areas.

FIG. 10 shows a leg spring made of a bent metal strip of spring sheet. This torsion spring has the spring legs 42, 42' for engagement in the groove 28 of the radial stop 25 of the leg 20 and in a further groove of the leg 20'. An arcuate, in particular circular, spring body 43 is arranged between the spring legs and has a free space 44 in the center into which the receiving pin 27 can be inserted at least in certain areas.

Many other types of spring are conceivable for use in the hanger within the scope of the present invention. For example, an involute spring can also be braced between the radial stops. Such a technique is already known from the field of garden shears.

The invention is not limited to the previously listed example embodiment.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

REFERENCE SIGN

1 Coat hanger
2 Suspension
3 Housing cassette
3*a* Middle part
4, 4' Counter stop
5, 5' circumferential groove
6 End stop
7 Inlet slope
8 receptable
9 Radial guide web
10, 10' operating element
11 Finger rest
12 Axle bolt
13 Connection area
14 Latching element
15 Support surface
16 Inlet slope
17 Edge area
18 step
19 Wing segment
20, 20' leg
21 leg arm
22 Housing cover segment
23 Coupling segment
23*a* groove
24, 24' latching element
25 Radial stop
26 Radial guide webs
27 Receiving pin
28 Groove
29 Cavity
31 Spring
32 Spring leg
33 Spring body
34 Free space
41 Spring
42 Spring leg
43 Spring body
44 Free space

The invention claimed is:

1. A clothes hanger comprising:

two legs, wherein each of the two legs include a leg arm;

a housing cassette, wherein the two legs are resiliently connected to one another via the housing cassette, wherein the housing cassette forms an angle vertex of an angle, and wherein the leg arms of the two legs form two angle legs of the angle, wherein an angular width of the angle is reducible by a pivoting movement of the two legs about a pivot axis with the build-up of a restoring force by the resilient connection; and at least one latching mechanism configured to secure the two legs against unintentional pivoting of the leg arms of the two legs; and a suspension configured to fix the clothes hanger, wherein, during the pivoting movement of the two legs, corresponding latching elements of the latching mechanism move away from one another or towards one another, wherein the housing cassette has a cavity in which a metal spring made from spring steel is arranged, wherein the metal spring is a torsion spring or leg spring, and wherein the corresponding latching elements are located above the two legs, are connected to the suspension, and are detachable from each other.

2. The clothes hanger of claim 1, wherein the corresponding latching elements are a latching lug and a corresponding latching groove, wherein the corresponding latching elements are connected to the two legs, the housing cassette, or integrally formed on the two legs or on the housing cassette.

3. The clothes hanger of claim 1, wherein the housing cassette is formed partially by housing cover segments integrally formed on the leg arms of the two legs.

4. The clothes hanger of claim 1, wherein the at least one latching mechanism includes at least two shape-identical latching mechanisms, wherein each of the at least two shape-identical latching mechanisms have two corresponding latching elements, and wherein the at least two shape-identical latching mechanisms secure the leg arms against unintentional rotation.

5. The clothes hanger of claim 4, wherein the at least two shape-identical latching mechanisms are arranged on opposite sides of the housing cassette, wherein the corresponding latching elements are arranged on an outer circumference of the housing cassette.

6. The clothes hanger of claim 1, wherein each of the two legs has one housing cover segment, wherein one of the corresponding latching elements is formed on the housing cover segment.

7. The clothes hanger of claim 6, further comprising:

an operating element is material-connected or form-fittingly connected to the two legs, wherein the operating element is tiltable about a tilting axis.

8. The clothes hanger of claim 7, wherein the operating element has a latching element of the latching mechanism, wherein the latching element is a latching groove.

9. The clothes hanger of claim 7, wherein the corresponding latching elements of the at least one latching mechanism are arranged on the operating element and are arranged on the housing cassette in such a way that the at least one latching mechanism is releasable by tilting the operating element with respect to the housing cassette.

10. The clothes hanger of claim 1, wherein, within the housing cassette, the two legs have a radial stop configured to limit the pivoting movement of the two legs.

11. The clothes hanger of claim 1, wherein, apart from the metal spring and the suspension, the clothes hanger is made of plastic.

12. The clothes hanger of claim 11, wherein, apart from the suspension, the clothes hanger has a mirror-symmetrical design, wherein the two legs are arranged point-symmetrically with respect to one another.

13. The clothes hanger of claim 1, wherein the corresponding latching elements are movably mounted in a circular path.

14. The clothes hanger of claim 1, wherein the corresponding latching elements are two different latching elements monolithically connected to a housing cover segment.

15. The clothes hanger of claim 14, wherein the two different latching elements are monolithically connected to one of the two legs.

16. The clothes hanger of claim 1, wherein the corresponding latching elements protrude on a circumferential side with respect to the housing cassette.

17. The clothes hanger of claim 1, wherein the clothes hanger consists of the two legs with housing cover segments integrally formed thereon, the at least one latching mechanism, a central ring between the housing cover segments, the suspension fixed to the central ring, the metal spring arranged in the housing cassette, and two operating elements.

* * * * *